US007093538B2

(12) United States Patent
Cheng

(10) Patent No.: US 7,093,538 B2
(45) Date of Patent: Aug. 22, 2006

(54) WOODEN DEBRIS COMPRESSOR

(75) Inventor: Chieh-Yuan Cheng, Taichung (TW)

(73) Assignee: San Ford Machinery Co., Ltd., Taichung (TW)

( * ) Notice: Subject to any disclaimer, the term of this patent is extended or adjusted under 35 U.S.C. 154(b) by 0 days.

(21) Appl. No.: 10/981,675

(22) Filed: Nov. 5, 2004

(65) Prior Publication Data

US 2006/0096472 A1 May 11, 2006

(51) Int. Cl.
*B30B 11/00* (2006.01)

(52) U.S. Cl. ..... 100/214; 100/94; 100/191; 100/215; 100/232; 100/240; 100/906; 144/3.1; 241/101.2; 241/283

(58) Field of Classification Search ..... 100/94, 100/95, 96, 97, 98 R, 191, 214, 215, 232, 100/240, 245, 906, 179, 178; 144/1.1, 2.1, 144/3.1; 221/30; 241/101.2, 283
See application file for complete search history.

(56) References Cited

U.S. PATENT DOCUMENTS 3,437,033 A * 4/1969 Day et al. ..... 100/215
5,471,919 A * 12/1995 Dabizzi ..... 100/7
5,873,304 A * 2/1999 Ruf ..... 100/97

* cited by examiner

*Primary Examiner*—Derris H. Banks
*Assistant Examiner*—Jimmy T. Nguyen
(74) *Attorney, Agent, or Firm*—Troxell Law Office, PLLC

(57) ABSTRACT

A wooden debris compressor includes a storing tank, and a poking device under the storing tank provided with plural poking rods fixed spaced apart in a definite angle. Then alternate back-and-forth rotation of the poking rods controls the volume of wooden debris falling down, and at the same time ax-shaped knives at outer ends of the poking rods rotates also back and forth alternately to break bridged conditions of wooden debris to let wooden debris smoothly fall down through a feeding hole. Then a cutting device with a cutter is provided on a material room of a feeding device to cut wooden debris in bridged conditions in an upper portion of the material room to let it fall down in a lower portion. Then the compressor can carry out compressing operation continuously and smoothly.

8 Claims, 8 Drawing Sheets

WOODEN DEBRIS COMPRESSOR

BACKGROUND OF THE INVENTION

1. Field of the Invention

This invention relates to a wooden debris compressor, particularly to one compressing wooden debris into wooden debris blocks for use.

2. Description of the Prior Art

Common wooden machines produce lots of wooden debris in their operation, and light and fluffy wooden debris may easily fly around in the air, giving bad effect to the air quality and human health. In disposing it in a bag or container, it needs much space, and moreover, it is also very flammable, having potential danger of get burned to cause disaster to lives and real estates.

A conventional wooden debris compressor has been developed, storing wooden debris in a storing tank with a poking device provided therein, for poking wooden debris to fall into a compressing device. Then a pressing rod in the compressing device compresses wooden debris into debris blocks.

However, common wooden debris is not in power condition to cause bridged conditions in case it is deposited and accumulated in a vertical condition so wooden debris may not easily fall into the feeding device in the conventional wooden debris compressor just described above. Therefore a poking device is used in the conventional compressor for an attempt of breaking bridging conditions. But the poking device has an elongate poking rod with only a little dimension for poking, incapable to break bridging condition completely and leaving some unbroken portion of the bridging conditions of wooden debris. Therefore, wooden debris cannot smoothly be fed into the feeding device, interrupting the operation of the conventional wooden debris compressor. In addition, during the process of wooden debris falling from the bottom of the storing tank to the feeding rod, bridging conditions may also happen so enough wooden debris may not move into the compressing device, causing interruption of compressing operation. Besides, the compressing device may also operate even in case of no load, resulting in waste of time and troubles in operational process.

SUMMARY OF THE INVENTION

This invention has been devised to offer a wooden debris compressor, which is provided with a plural poking rods in a poking device under a storing tank, for controlling falling volume of wooden debris by back-and-forth rotation of the poking rods, and also for breaking bridging conditions of wooden debris by ax-shaped knives at the end of the poking rods so as to let wooden debris smoothly fall down through the feeding hole. Further, a cutting device with a cutter is provided on a material room of the feeding device so the bridging conditions of wooden debris formed in the upper portion of the material room can be also broken by the cutter to fall easily down to the bottom. Thus, the wooden debris compressor in the invention breaks in due time bridging conditions possible formed under the storing tank and on the feeding device to continuously and smoothly compress wooden debris, effectively getting rid of the drawbacks of the conventional wooden debris compressor, that is, interruption of compressing operation and idle running of the power under no load.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
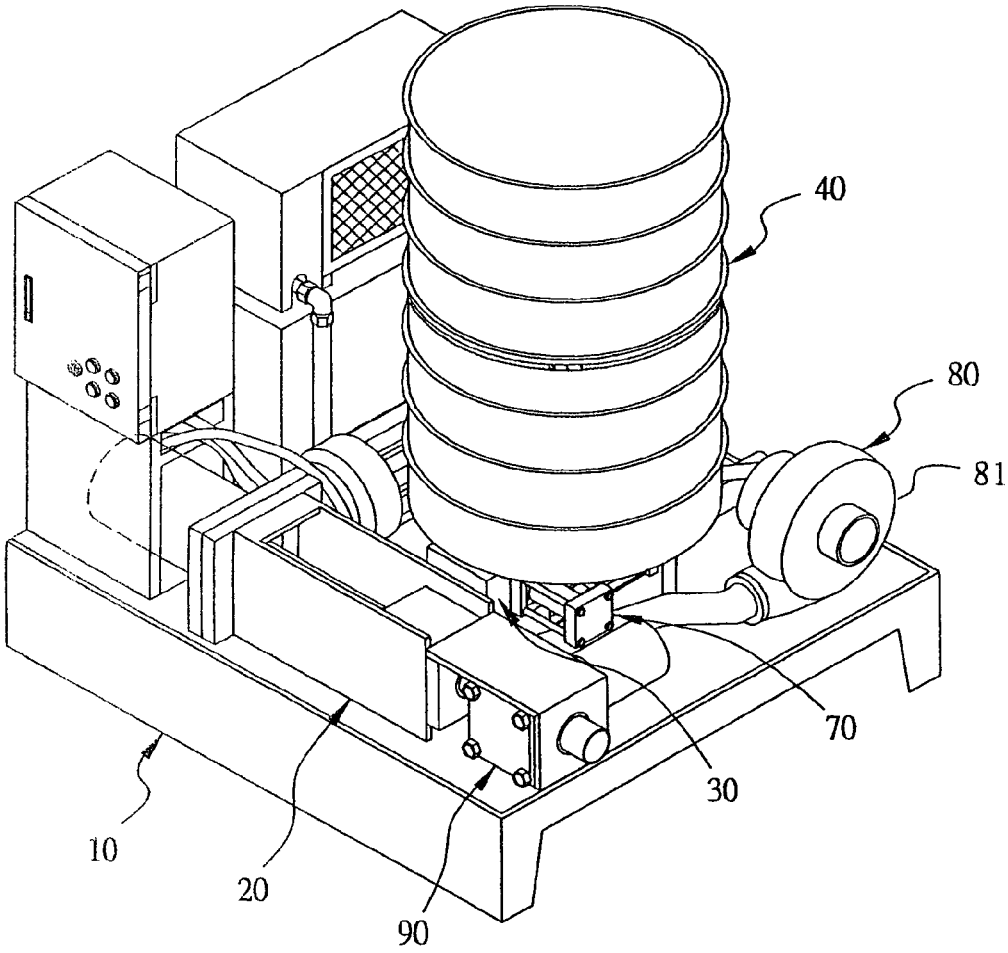
FIG. 1 is a perspective view of a wooden debris compressor in the present invention.
Figure 2:
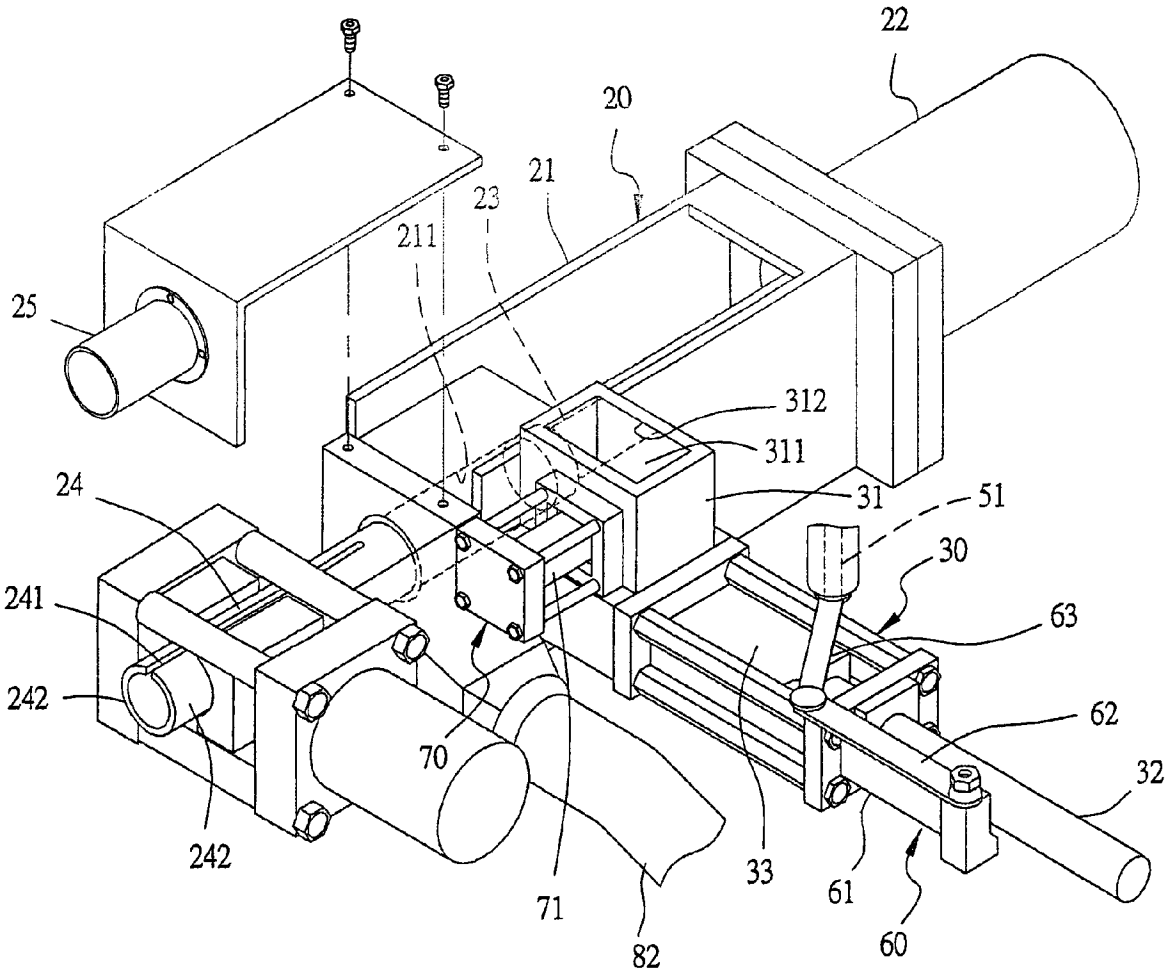
FIG. 2 is a perspective view of the combination of a compressing device, a feeding device, a reciprocating device, a cutting device and a clamping device in the present invention.
Figure 3:
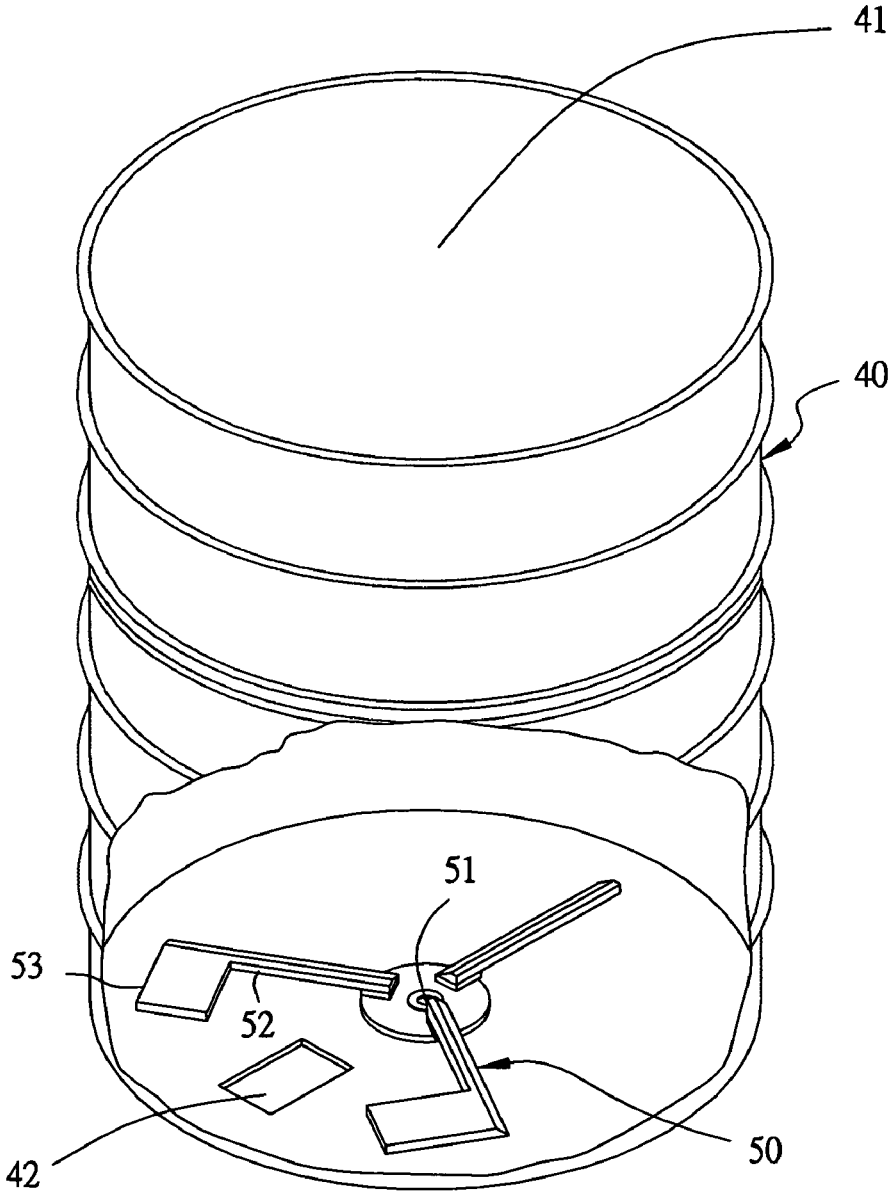
FIG. 3 is a perspective view of a storing tank and a poking device in the present invention.

A preferred embodiment of a wooden debris compressor in the present invention, as shown in FIGS. 1, 2 and 3, includes a base 10, a compressing device 20, a feeding device 30, a storing tank 40, a poking device 50, a reciprocating device 60, a cutting device 70, a cooling device 80, and a clamping device 90 as main components.

The compressing device 20 consists of a base member 21, a compress room 211 formed on the base member 21, a liquid cylinder 22 with a compress rod 23 that extends and reciprocates in the compress room 211 for compressing wooden debris into blocks, and a pressure tube 24 fixed at the other end of he liquid tank 22 and communicating with the compress room 211. The pressure tube 24 has two opposite lengthwise slots 241 to divide it into two half tubes 242 that can expand to some extent in case of pressure caused by wooden debris compressed therein. Further, a debris block outgoing tube 25 is fixed with an outer end of the pressure tube 24, for finished debris blocks to stay therein temporarily and be gradually pushed out.

Figure 4:
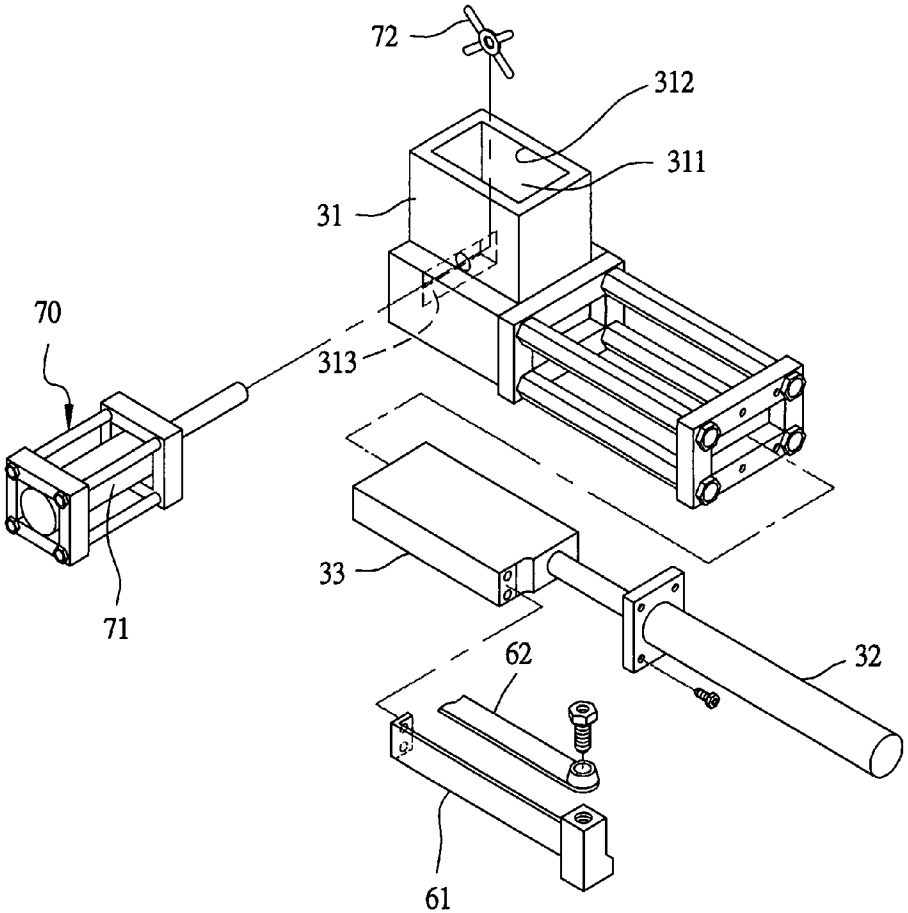
FIG. 4 is a partial exploded perspective view of the feeding device and the cutting device in the present invention.

The feeding device 30 shown in FIG. 4 is fixed with one side of the compress device 20, consisting of a base member 31, a material room 311 formed in the base member 31, a dropping hole 312 formed on the material room 311, and a feeding hole 313 formed under one side of the material room 311 and communicating with the compress room 211, a liquid cylinder 32 fixed on the base member 31 and having a feeding rod 33 that reciprocates under the material room 311 for sealing up the feeding hole 313.

The storing tank 40 is fixed on the feeding device 30, having a storing hollow 41 to store wooden debris therein, a fall hole 42 formed in the bottom of the storing tank 41 and communicating with the dropping hole 312 of the feeding device 30 for wooden debris to fall from the fall hole 42 into the material room 311.

The poking device 50 is located under the storing tank 41, consisting of a rotary shaft 51 and three poking rods 52 all connected with and rotated simultaneously by the rotary shaft 51, an ax-shaped knife 53 respectively formed at the ends of two of the three poking rods 52 and able to move back and forth on the hole 42 during back-and-forth rotation of the poking rods 52.

The reciprocating device 60 is fixed under the poking device 50, consisting of a pull rod 61 fixed at the outer side of the feeding rod 33 of the feeding device 30 and moving together with the feeding rod 33, and a first connect rod 62 pivotally connected to the other end of the pull rod 61, a second connect rod 63 pivotally connected with the other end of the first connect rod 62 and having its other end fixed firmly with the rotary shaft 51 so the rotary shaft 51 may be rotated back and forth, with the poking rods 52 rotated back and for the forth alternately.

The cutting device 70 is located on the material room 311 of the feeding device 30, consisting of a liquid cylinder 71 with a piston rod having its outer end fixed with a cross-shaped cutter 72 so that the cutter 72 may move back and forth in the upper portion of the material room 311.

The cooling device 80 is fixed on the base 10, consisting of a blower 81, and a wind pipe 82 connected to the blower 81 for sending cool air sucked into the pressure tube 24 to cool down the pressure tube 24 to prevent it from inflating by heat.

The clamping device 90 is fixed on the base 10, consisting of a stationary clamping block 91, a movable clamp block 92 and a liquid cylinder 93. The stationary clamp block 91 is fixed on an outer surface of one of the two half tubes 242 of the pressure tube 24, and the movable block 92 is connected to and moved back and forth by the piston rod of the liquid cylinder 93, fixed on the other of the two half tubes 242 so that the pressure tube 24 may be clamped by the two blocks 91 and 92 together to restrict the expansion of the pressure tube 24. Further, the liquid cylinder 93 can be adjusted in its liquid pressure for adjusting the density of wooden debris blocks to be compressed.

Figure 5:
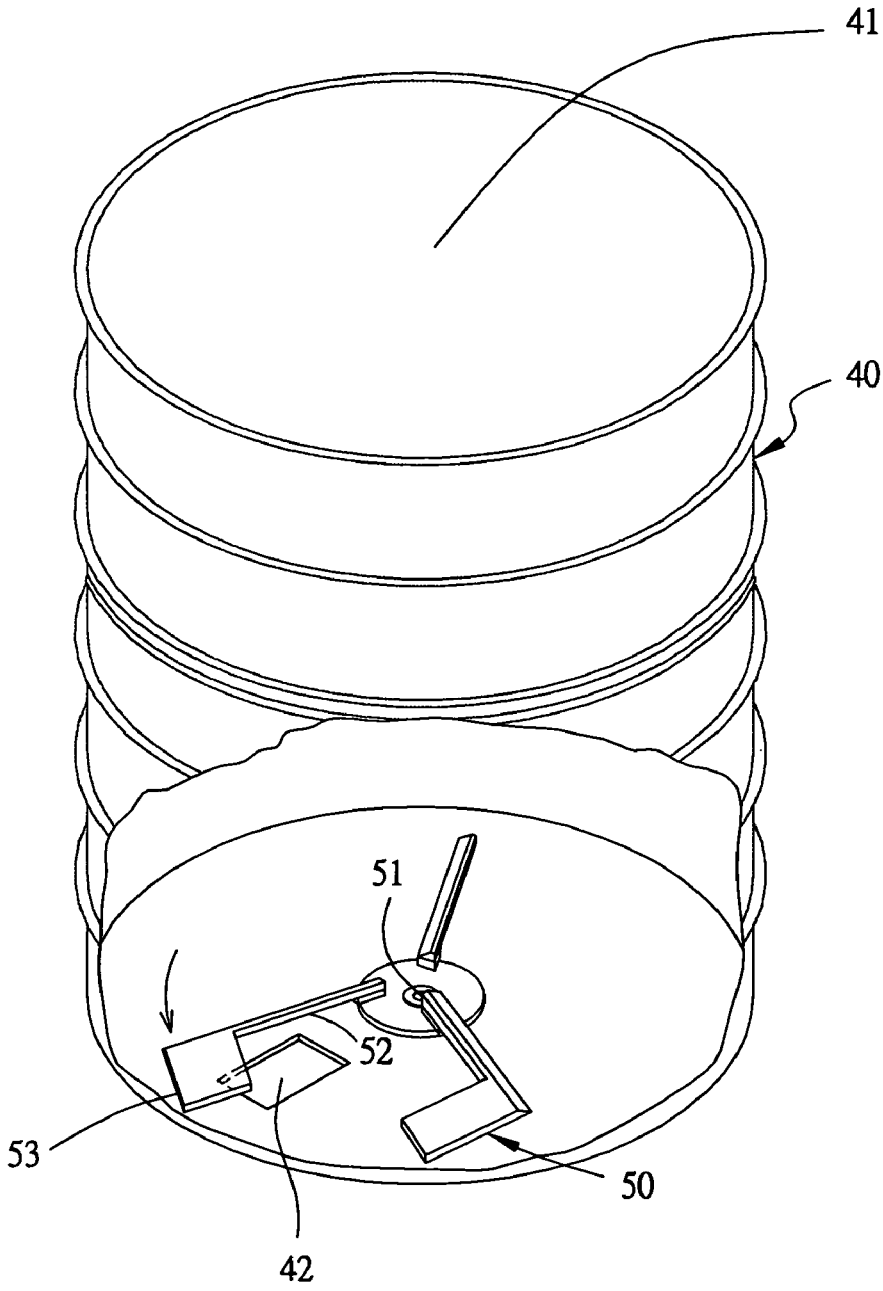
FIG. 5 is a perspective view of the poking device under a poking movement in the present invention.
Figure 6:
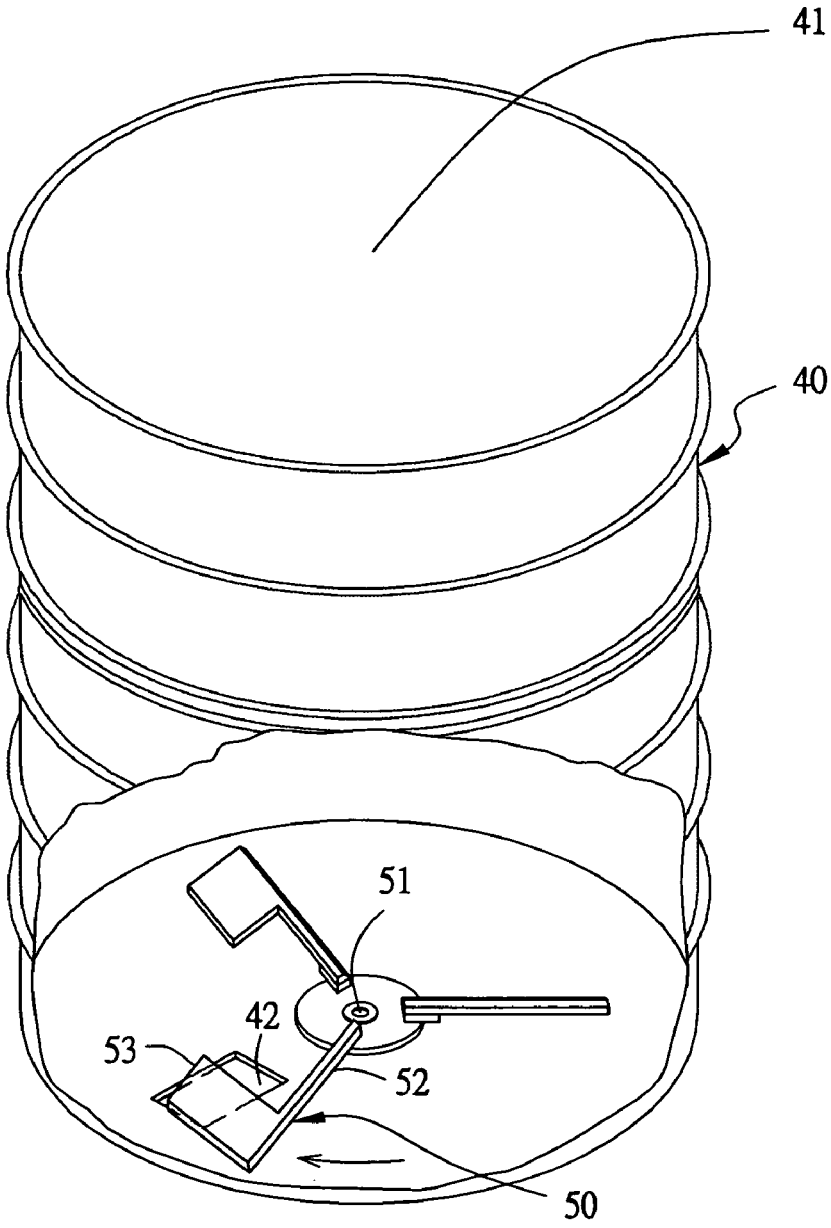
FIG. 6 is a perspective view of the poking device under another poking movement in the present invention.
Figure 7:
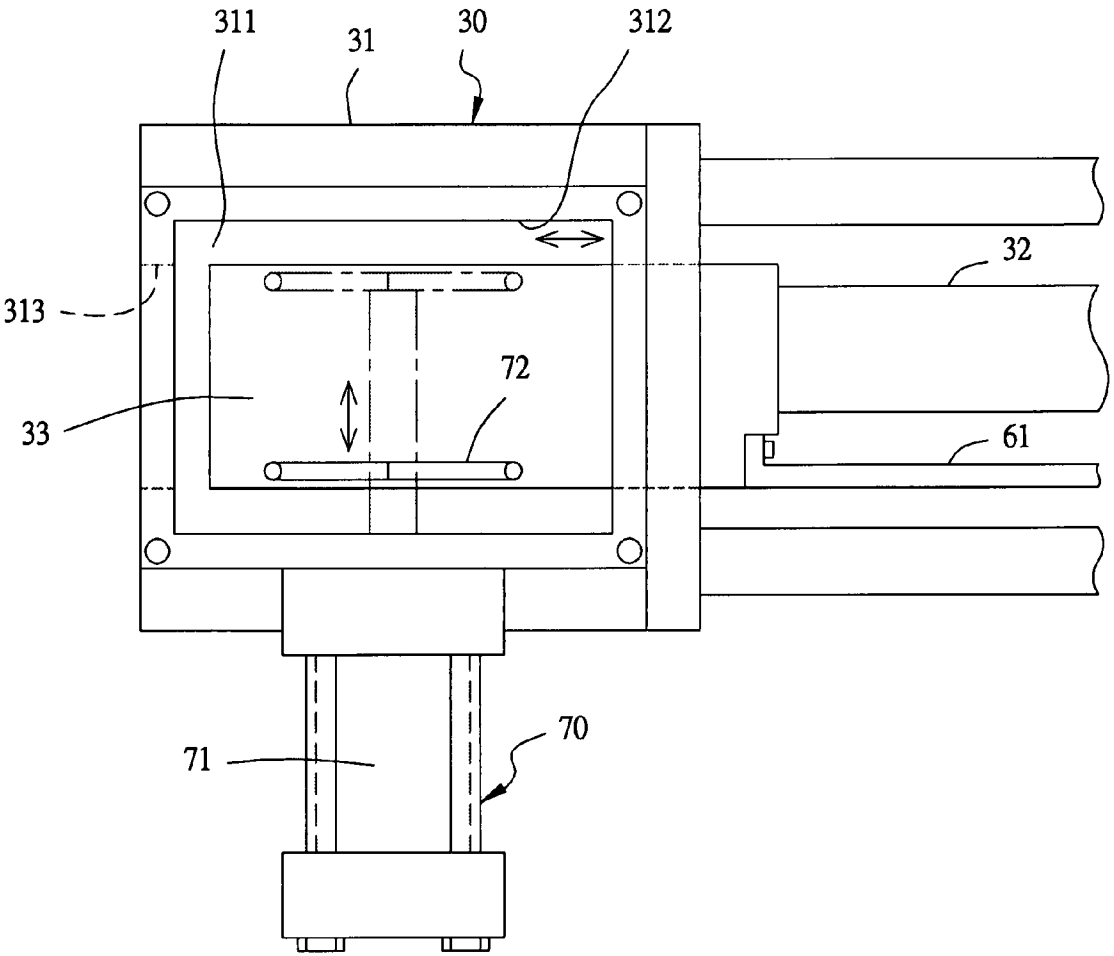
FIG. 7 is an upper view of the feeding device and the cutting device in the present invention, showing their moving direction in the present invention; and, FIG. 8 is an upper view of the compressing device, the feeding device, the clamping device and a cooling device in the present invention, showing their moving direction.
Figure 8:
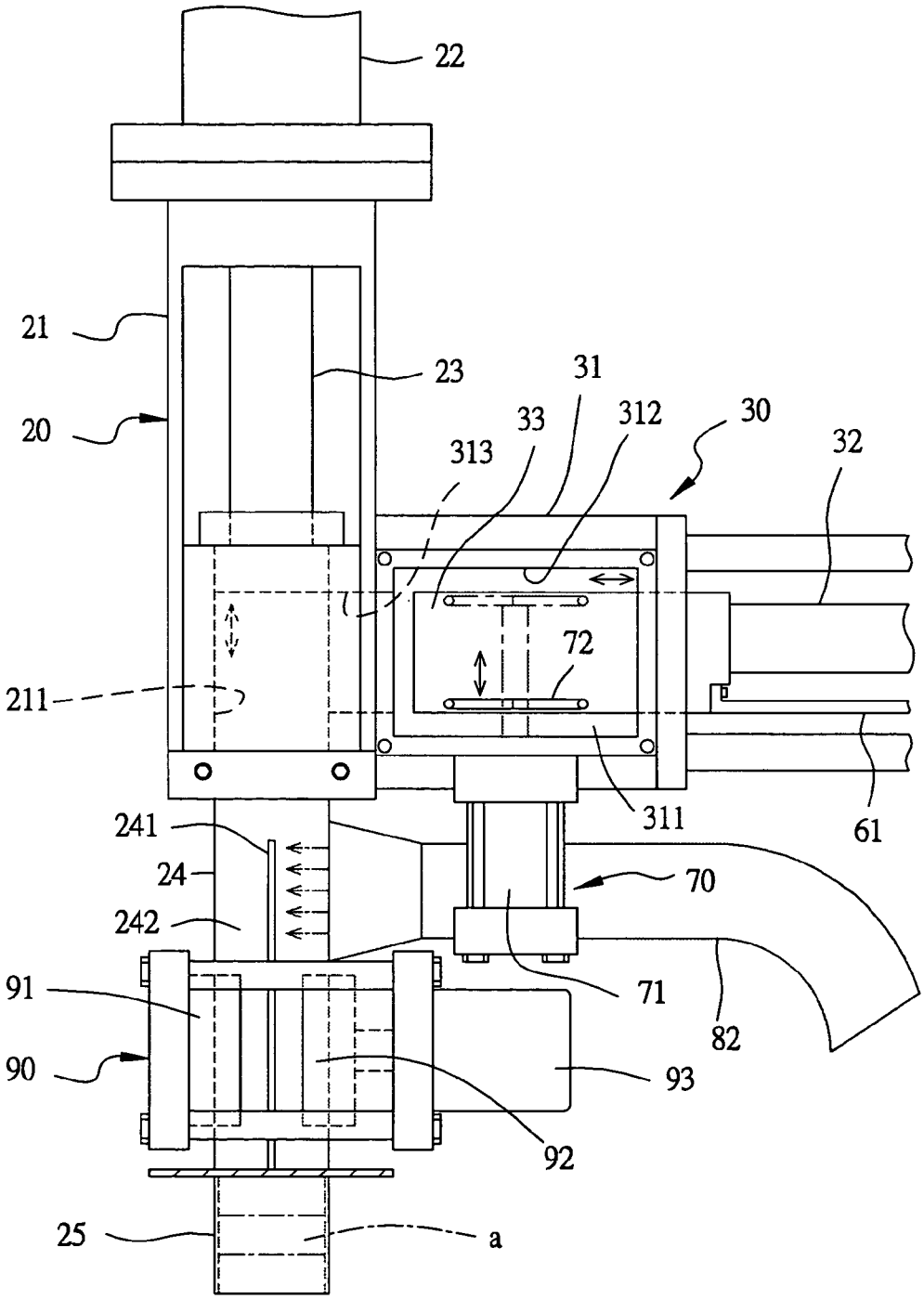

In operating the wooden debris compressor, referring to FIGS. 5 and 6, at first, wooden debris is poured in the storing tank 41, the feeding device 30 is started to let the piston rod of the liquid cylinder 32 extending out to actuate the pull rod 61 of the reciprocating device 60, rotating back and forth the rotary shaft 51 by mutual movement of the first and the second connect rods 62 and 63. Then the poking rods 52 may be rotated subsequently, to control wooden debris to fall in a preset volume, and meanwhile the two ax-shaped knives 52 at the right and left side of the fall hole 42 moving back and forth on the hole 42 alternately, breaking bridging conditions of wooden debris possibly formed in the storing tank 41 so as to let the broken wooden debris fall down through the fall hole 42. In case the piston rod of the liquid cylinder 32 is retreated, the ax-shaped knives 53 with the poking rods 52 are at once rotated backward. Then the wooden debris falling down through the fall hole 42 may continue to fall through the dropping hole 312 of the feeding device 30 and further falls to the upper portion of the material room 311 and then to the lower portion thereof. As shown in FIG. 7, at this time, the liquid cylinder 32 of the feeding device 30 may move its feeding rod 33 to push the wooden debris in the lower portion of the material room 311 through the feeding hole 313 into the compress room 211 of the compressing device 20. Then the liquid cylinder 22 of the compressing device 20 may move the compress rod 23 outward to compress wooden debris in the compress room 211 into the pressure tube 24 so the wooden debris may be gradually compressed in the pressure tube 24 to become a debris block (a) of a certain length and in closely packed condition after a certain time of high pressure, and finally pushed into the debris block outgoing tube 25 to stay temporarily therein, as shown in FIG. 8. Thus, finished debris blocks (a) are gradually pushed out of the block outgoing tube 25

Next, it is necessary to mention that as shown in FIG. 7, whenever before the feeding rod retreats to push wooden debris, the liquid cylinder 71 of the cutting device 70 has to be started to let the cutter 72 move to the upper portion of the material room 311 to break wooden debris in the bridged condition therein before falling down to the lower portion of the material room 311, for ensuring falling action of wooden debris and subsequently smoothing compressing operation without interruption.

The invention has the following advantages, as can be understood from the foresaid description.

1. Provision of the ax-shape knives fixed at the outer ends of he poking rods 52 and the cutting device 70 on the material room 311 of the feeding device 30 can break bridging conditions of wooden debris in due time, ensure smooth dropping of wooden debris through the fall hole 42 of the storing tank 41 and then in the lower portion of the material room 31, carrying out compressing operating without interruption or idle operation.

2. As the ax-shape knives 53 of the poking rods 52 have the same size as the fall holes 42, the volume of wooden debris dropping therethrough are almost the same every time so as to let the volume of the wooden debris falling down controllable.

3. As the pressure tube 24 is clamped elastically by the clamping device 90, the pressure tube 24 can be restricted in its expansion by adjusting the liquid pressure in the liquid cylinder 9, for controlling the density of the finished debris blocks (a), and besides, the liquid pressure can be adjusted according to the condition of wooden debris, such as its powder or particle or thin sheet shape, density, coarseness, etc., for making debris blocks (a) of a preset density.

4. The density of debris blocks can be effectively controlled, as the pressure tube 24 can be prevented from inflating caused by heat, as the cooling device 80 is matched with the compressing device 20 for cooling the pressure tube 24.

5. The pull rod 61 of the reciprocating device 60 is moved by the liquid cylinder 32, so the reciprocating device 60, the poking device 50 and the feeding device 30 are all operated by the same liquid pressure system, saving the cost of the machine and ensuring accurate operational sequence of those devices.

While the preferred embodiment of the invention has been described above, it will be recognized and understood that various modifications may be made therein and the appended claims are intended to cover all such modifications that may fall within the spirit and scope of the invention.

What is claimed is:

1. A wooden debris compressor comprising:

a base;

a compressing device consisting of a base member, a compress room formed in said base member, a liquid cylinder fixed at one side of said compress room and having a compress rod to move back and forth in said compress room for compressing wooden debris into a debris block;

a feeding device provided at one side of said compressing device and consisting of a base member, a material room formed in said base member, a dropping hole formed in an upper side of said material room, a feeding hole bored in a lower wall of said material room and communicating with said compress room of said compressing device, a liquid cylinder provided on said base member and having a feeding rod to move back and forth in a lower portion of said material room so as to push wooden debris into said compress room and also closing up said feeding hole;

a storing tank provided on said feeding device, having a storing hollow for storing wooden debris therein, a fall hole bored in a bottom of said storing tank and communicating with the feeding hole of said feeding device for wooden debris to fall into said material room;

a poking device provided under said storing tank and having at least two poking rods to rotate back and forth alternately, each said poking rod having an ax-shape knife at their outer end, said poking rods rotating to shift back and forth on said fall hole of said storing tank so as to break wooden debris in bridged conditions for letting broken wooden debris to fall smoothly through said fall hole;

a cutting device provided on said material room of said feeding device and having a liquid cylinder, said liquid cylinder having a piston rod to push to move a cutter of said cutting device in an upper portion of said material room for breaking wooden debris in bridged conditions so as to let the broken wooden debris fall smoothly into the lower portion of said material room to be pushed by said feeding rod.

2. The wooden debris compressor as claimed in claim 1, wherein said compress room of said compressing device has a pressure tube connected with the opposite side to said liquid cylinder of the compressing device, said pressure tube has two opposite lengthwise slots to divide said pressure tube into two half tubes, which are expanded by the pressure received by wooden debris pushed therein, and a clamping device is provided around its outer circumference to clamp elastically said pressure tube so as to control the density of finished debris blocks.

3. The wooden debris compressor as claimed in claim 2, wherein said clamping device is installed on said base, and has a stationary clamp block fixed on an outer surface of one of said half tubes, a movable clamp block connected to a piston rod of a liquid cylinder thereof and contacting with an outer surface of the other of said half tubes, so said stationary and said movable clamp block clamps said pressure tube elastically.

4. The wooden debris compressor as claimed in claim 2, where said pressure tube has a material outlet tube connected to its outer end, so wooden debris blocks after finished may be temporarily received therein and gradually pushed out.

5. The wooden debris compressor as claimed in claim 2, wherein a cooling device is further provided matched to said compressing device for cooling said pressure tube in order to prevent said pressure tube from inflating by heat.

6. The wooden debris compressor as claimed in claim 5, wherein said cooling device includes a blower, and a wind pipe connected to said blower to so as to suck cool air into said pressure tube.

7. The wooden debris compressor as claimed in claim 1, wherein said cutter of said cutting device is cross-shaped, and the intersection of the cross-shaped cutter is connected to the piston rod of said liquid cylinder.

8. The wooden debris compressor as claimed in claim 1, wherein a reciprocating device is further provided to match with said poking device, said reciprocating device has a pull rod, which has one end connected to said feeding rod and the other end pivotally connected to a first connect rod, said first connect rod having its other end pivotally connected to a second connect rod, said second connect rod having its other end fixed with a rotary shaft of said poking rods for rotating said poking rods back and forth alternately.

* * * * *